US010096273B2

(12) United States Patent
Fan et al.

(10) Patent No.: US 10,096,273 B2
(45) Date of Patent: Oct. 9, 2018

(54) DEBUGGING METHOD FOR OVERDRIVE TABLE

(71) Applicant: Shenzhen China Star Optoelectronics Technology Co., Ltd., Shenzhen, Guangdong (CN)

(72) Inventors: Yong Fan, Guangdong (CN); Chih Tsung Kang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 127 days.

(21) Appl. No.: 14/417,865

(22) PCT Filed: Jan. 16, 2015

(86) PCT No.: PCT/CN2015/070926
§ 371 (c)(1),
(2) Date: May 9, 2016

(87) PCT Pub. No.: WO2016/106871
PCT Pub. Date: Jul. 7, 2016

(65) Prior Publication Data

US 2016/0247427 A1 Aug. 25, 2016

(30) Foreign Application Priority Data

Dec. 31, 2014 (CN) ..... 2014 1 0855186

(51) Int. Cl.
*G09G 3/36* (2006.01)
*G09G 3/00* (2006.01)
(Continued)

(52) U.S. Cl.
CPC ..... *G09G 3/006* (2013.01); *G09G 3/2007* (2013.01); *G09G 3/36* (2013.01); *G09G 3/3413* (2013.01);
(Continued)

(58) Field of Classification Search
CPC ..... G09G 3/006; G09G 3/2007; G09G 3/36; G09G 3/3413; G09G 2320/0693;
(Continued)

(56) References Cited

U.S. PATENT DOCUMENTS

2008/0094426 A1* 4/2008 Kimpe ..... G09G 3/20 345/691
2014/0347384 A1 11/2014 Kwak et al.
(Continued)

FOREIGN PATENT DOCUMENTS

CN 101136188 A 3/2008
CN 101707051 A 5/2010
(Continued)

OTHER PUBLICATIONS

International Search Report and Written Opinion, Jan. 16, 2015, China.

*Primary Examiner* — Julian Huffman
*Assistant Examiner* — Michael Konczal
(74) *Attorney, Agent, or Firm* — Kim Winston LLP

(57) ABSTRACT

A method for debugging an overdrive table is disclosed. The method comprises the steps of establishing debugging conditions for debugging overdrive gray-scale values in overdrive table of different primary colors according to a partition mode of a liquid crystal display device, backlights of two color fields, and a refresh rate of the backlight. According to the method, various factors which influence the display effect of the liquid crystal display panel are taken into consideration when the overdrive table is debugged, whereby the accuracy of the overdrive table can be improved significantly, and a better display effect can be achieved.

7 Claims, 3 Drawing Sheets

(51) Int. Cl.
*G09G 3/20* (2006.01)
*G09G 3/34* (2006.01)

(52) U.S. Cl.
CPC ..... *G09G 2310/0235* (2013.01); *G09G 2320/0247* (2013.01); *G09G 2320/0252* (2013.01); *G09G 2320/0285* (2013.01); *G09G 2320/0693* (2013.01); *G09G 2330/12* (2013.01); *G09G 2340/16* (2013.01)

(58) Field of Classification Search
CPC ... G09G 2320/0252; G09G 2320/0285; G09G 2320/0247; G09G 2310/0235; G09G 2340/16; G09G 2330/12
See application file for complete search history.

(56) References Cited

U.S. PATENT DOCUMENTS

| | | | | |
|---|---|---|---|---|
| 2016/0071449 | A1* | 3/2016 | Miyata ..... | G09G 3/3607 345/690 |
| 2016/0247459 | A1* | 8/2016 | Fan ..... | G09G 3/36 |

FOREIGN PATENT DOCUMENTS

| | | | |
|---|---|---|---|
| CN | 101847381 | A | 9/2010 |
| CN | 101887681 | A | 11/2010 |
| CN | 104019404 | A | 9/2014 |
| CN | 104077991 | A | 10/2014 |

* cited by examiner

DEBUGGING METHOD FOR OVERDRIVE TABLE

CROSS REFERENCE TO RELATED APPLICATION

The present application claims benefit of Chinese patent application CN 201410855186.9, entitled "Debugging Method for Overdrive Table" and filed on Dec. 31, 2014, which is incorporated herein by reference.

FIELD OF THE INVENTION

The present disclosure relates to the technical field of driving a liquid crystal display device, and particularly to a debugging method for an overdrive table.

BACKGROUND OF THE INVENTION

The methods for driving a liquid crystal display device comprise overdrive method at present. The overdrive method means that when a voltage of a target state of liquid crystal molecules is higher than a present voltage of the liquid crystal molecules, a voltage which is higher than the voltage of the target state of the liquid crystal molecules is applied to the liquid crystal molecules; and when the voltage of the target state of the liquid crystal molecules is lower than the present voltage of the liquid crystal molecules, a voltage which is lower than the voltage of the target state of the liquid crystal molecules is applied to the liquid crystal molecules. The voltage which is higher or lower than the voltage of the target state of the liquid crystal molecules applied thereto is called an overdrive voltage.

The rotation speed of the liquid crystal molecules can be accelerated through the overdrive method, whereby a gray-scale response time of the liquid crystal molecules can be reduced. The specific value of the overdrive voltage can be obtained through inquiring an overdrive table. Specifically, the overdrive table is inquired according to a gray-scale value of the target state and a gray-scale value of the present state to obtain an overdrive gray-scale value, which corresponds to the overdrive voltage. In general, the overdrive table is a group of data that is stored in a memory, and the accuracy of the overdrive table determines the effectiveness of the overdrive method, i.e., whether the gray-scale response time of the liquid crystal molecules can be reduced significantly.

In the prior art, the overdrive table is obtained mainly based on experimental means. A certain amount of debugging data is firstly recorded through experiments, and then the overdrive table is established according to a manual algorithm or a specific algorithm based on the debugging data.

However, when a liquid crystal display panel is driven by the overdrive table that is obtained through the debugging method in the prior art, the display effect during experiments cannot be achieved in most cases. The reason is that in debugging experiments, the debugging condition is relatively simple, and the overall influence of various other factors on the display effect of the liquid crystal display device during practical use is neglected. For example, in the prior art, the overdrive table is generally debugged with a single color light (mainly white light) as a backlight.

In a word, in order to solve the aforesaid technical problem, a method for debugging the overdrive table in which the influences of various factors on the display effect of the liquid crystal display device during practical use can be taken into overall consideration is urgently needed.

SUMMARY OF THE INVENTION

One of the technical problems to be solved by the present disclosure is to provide a method for debugging the overdrive table in which the influences of various factors on the display effect of the liquid crystal display device during practical use can be taken into overall consideration.

In order to solve the aforesaid technical problem, the embodiment of the present disclosure provides a method for debugging an overdrive table, comprising the following steps: partitioning a backlight into partitions according to a partition mode of a liquid crystal display device; selecting a backlight which is used when overdrive tables of different primary colors are debugged according to backlights of two color fields of the liquid crystal display device; and activating the backlight according to a refresh rate of color fields of the liquid crystal display device, and debugging overdrive gray-scale values in overdrive tables of different primary colors.

Preferably, when an overdrive table of a primary color is debugged, a backlight of the backlights of the two color fields of the liquid crystal display device which represents the primary color better serves as the backlight which is used during debugging.

Preferably, when an overdrive table of red color is debugged, a red backlight is selected; and when overdrive tables of green color and blue color are debugged, a white backlight or a cyan backlight is selected.

Preferably, the method further comprising debugging the overdrive gray-scale values in the overdrive tables of different primary colors based on any one of the partitions.

Preferably, the method further comprising, with respect to each of the partitions, debugging the overdrive gray-scale values in the overdrive tables of different primary colors, thus obtaining the overdrive tables corresponding to each of the partitions respectively.

Preferably, a refresh rate of the backlight which is used during debugging is 120 Hz.

Preferably, a duty ratio of the refresh rate of the backlight ranges from 10% to 40%.

Compared with the prior art, one embodiment or a plurality of embodiments according to the present disclosure may have the following advantages or beneficial effects.

According to the embodiments of the present disclosure, a debugging condition of the overdrive table is established based on partitions of the backlight and an alternation of the backlight of the liquid crystal display device during practical use, so that the debugging condition of the overdrive table can conform to the practical use condition of the liquid crystal display device better. In this manner, an accuracy of the overdrive table can be improved significantly, and thus a better display effect can be achieved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Figure 1:
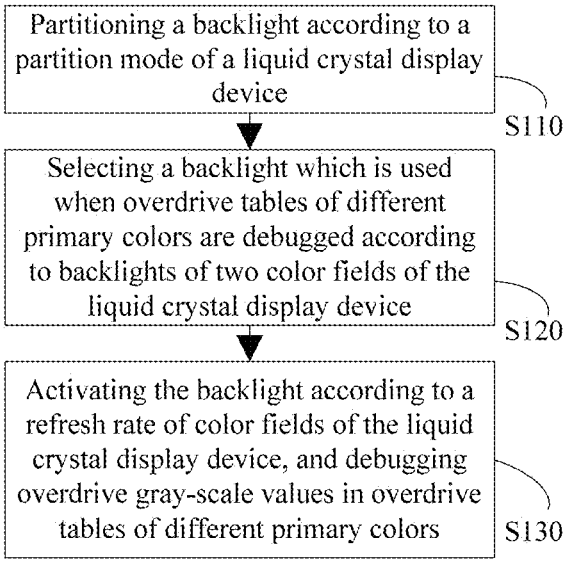
FIG. 1 is a flow chart of a method for debugging an overdrive table according to an embodiment of the present disclosure.
Figure 2:
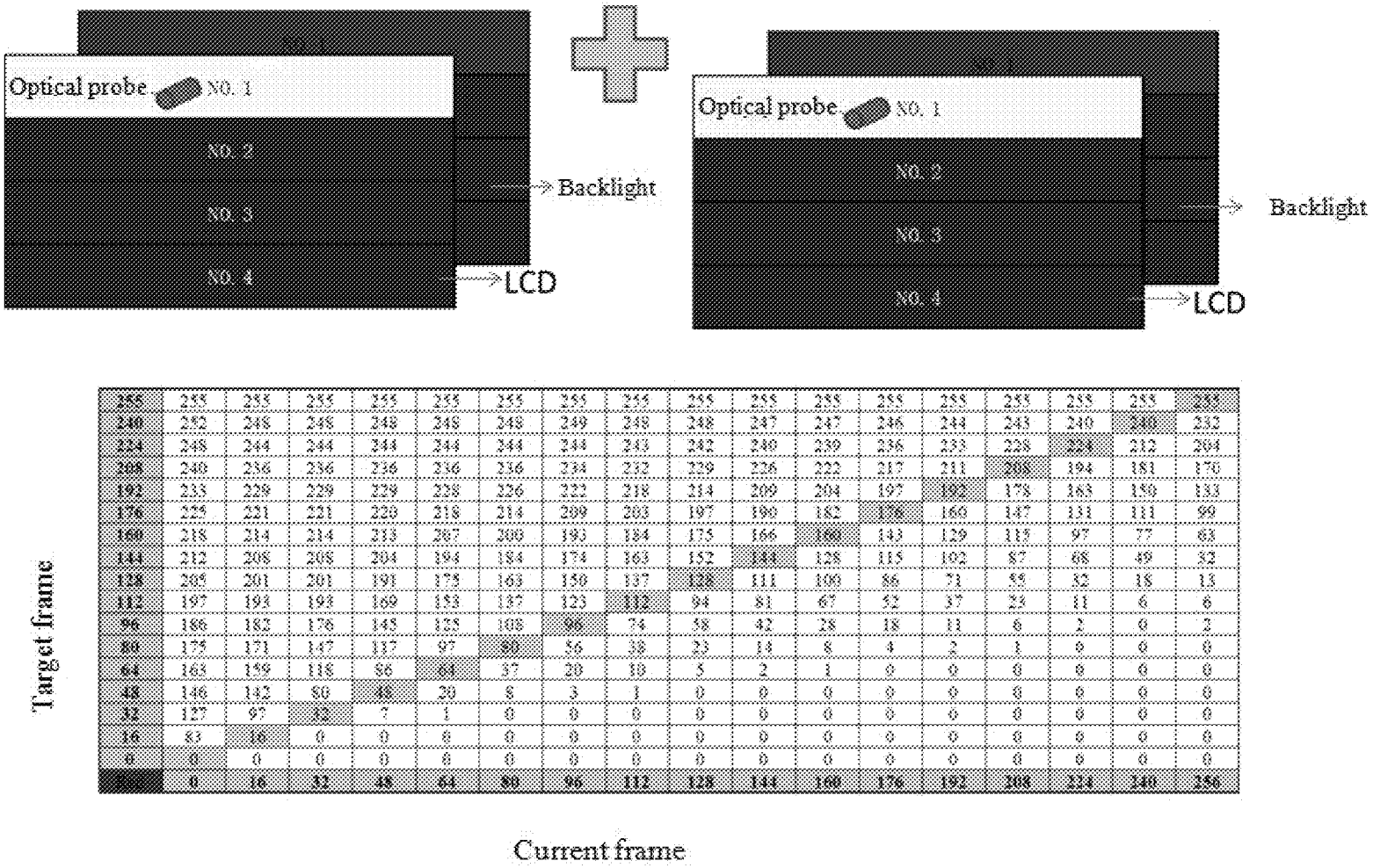
FIG. 2 schematically shows a debugging procedure of the overdrive table of a TGB-FSC liquid crystal display device according to the embodiment of the present disclosure.

FIG. 1 is a flow chart of a method for debugging an overdrive table according to an embodiment of the present disclosure, and FIG. 2 schematically shows a debugging procedure of the overdrive table of a TGB-FSC liquid crystal display device according to the embodiment of the present disclosure, wherein TGB refer to transparent sub pixels, green sub pixels and blue sub pixels respectively, and FSC is short for Field Sequential Color. The debugging method according to the embodiment of the present disclosure will be illustrated below with reference to FIGS. 1 and 2. The method for debugging the overdrive table according to the present disclosure can be used in the FSC liquid crystal display device which is driven through two color fields.

In step S110, a backlight is partitioned according to a partition mode of a liquid crystal display device.

In step S120, a backlight which is used when overdrive tables of different primary colors (which are red color, green color, and blue color respectively) are debugged is selected according to backlights of two color fields of the liquid crystal display device.

Specifically, when the overdrive table is debugged, the backlight is partitioned mainly according to the partition mode of the backlight of the liquid crystal display device which is driven by the overdrive table, and activated according to different degrees of brightness of backlights of the partitions. Further, the overdrive table can be debugged based on different partitions, so that overdrive tables corresponding to different partitions can be obtained respectively. One of the benefits that can be brought about by partitioning the backlight when the overdrive table is debugged is that the interaction among the partitions of the backlight can be reduced.

In the prior art, the liquid crystal display devices are mostly driven based on the partitions of the backlight. The advantages that the liquid crystal display device is driven based on the partitions of the backlight lie in that a contrast of an image can be improved, a tailing phenomenon when dynamic images are displayed can be eliminated, and a power consumption of the liquid crystal display device can be reduced. However, in addition to the above beneficial effects, some problems can also be brought about by the partitions of the backlight. One of the most important problems is the interaction among different partitions of the backlight. Specifically, the backlight of one partition would transmit to other partitions which are adjacent to said partition, and thus the image displayed on the liquid crystal display device would be ultimately affected.

According to the embodiments of the present disclosure, when the overdrive table is debugged, the influences of these factors on the partitions of the backlight are taken into consideration. That is, the debugging condition is established in consistence with the practical use condition of the liquid crystal display device. It can be understood that, the overdrive table which is debugged under such a condition can be satisfactorily adaptive to the interaction among the partitions of the backlight.

For example, as shown in FIG. 2, with respect to a liquid crystal display device with a backlight that is partitioned into four partitions along a row scanning direction, when the overdrive table thereof is debugged, the backlight which is used during debugging can also be partitioned into four partitions along the row scanning direction. At the same time, the backlights are activated according to different degrees of brightness of the backlights obtained from a test pattern (reference can be made to the standard of Video Electronics Standards Association, i.e., VESA). In addition, the overdrive table can be debugged based on different partitions, so that four groups of overdrive tables corresponding to four partitions can be obtained respectively, wherein each group of overdrive tables comprise an overdrive table of red color, an overdrive table of green color, and an overdrive table of blue color.

Further, with respect to the liquid crystal display devices based on the display principle of Field Sequential Color (FSC), the three primary colors are generally formed after the backlights of different colors transmit through different color fields. It is obvious that, as to the overdrive table which is used in this kind of liquid crystal display device, if the debugging thereof is still performed with a single color light (which is mainly white color light) as the backlight, the debugging accuracy would be affected inevitably.

According to the embodiments of the present disclosure, the backlights which are used when the overdrive table of red color, the overdrive table of green color, and the overdrive table of blue color are debugged respectively are selected according to the backlights of the two color fields of the liquid crystal display device during practical use. Specifically, when the overdrive table of red color is debugged, a backlight that comprises red color, which is one of the three primary colors, is selected from the backlights of the two color fields to serve as the backlight that is used during debugging; when the overdrive table of blue color is debugged, a backlight that comprises blue color, which is one of the three primary colors, is selected from the backlights of the two color fields to serve as the backlight that is used during debugging; and when the overdrive table of green color is debugged, a backlight that comprises green color, which is one of the three primary colors, is selected from the backlights of the two color fields to serve as the backlight that is used during debugging.

For example, with respect to the TGB-FSC liquid crystal display device with red light and white light serving as the backlights of the two color fields respectively, when the overdrive table of red color is debugged, the red light is selected to serve as the backlight that is used during debugging; when the overdrive table of green color is debugged, the white light is selected to serve as the backlight that is used during debugging; and when the overdrive table of blue color is debugged, the white light is selected to serve as the backlight that is used during debugging.

In general, the backlights of the two color fields comprise red light, blue light and green light during practical use of the liquid crystal display device.

In step S130, the backlight is activated according to a refresh rate of the color fields of the liquid crystal display device during practical use, and overdrive gray-scale values in overdrive tables of red color, blue color, and green color are debugged respectively.

For example, according to one embodiment, if the refresh rate of the FSC liquid crystal display device which is driven through two color fields is 120 Hz, the refresh rate of the backlight should be 120 Hz when the overdrive table of the liquid crystal display device is debugged, and a duty ratio of the refresh rate of the backlight can be selected according to a requirement of the display effect. When current of the backlight is kept constant, different duty ratios correspond to different degrees of brightness of the backlight. The duty ratio of the refresh rate of the backlight can be selected in a range from 10% to 40% in general.

During practices, there is a certain limit value for the response speed of liquid crystals. When the response speed of liquid crystals is constant, the higher the duty ratio of the refresh rate is, the poorer the colors of the image displayed therein would become. In addition, if the duty ratio of the refresh rate is rather low, lower than 10% for example, the power consumption of the backlight would increase. Therefore, when the overdrive table is debugged, the duty ratio of the refresh rate of the backlight preferably ranges from 10% to 40%. In this manner, not only the power consumption thereof can be reduced, but also a better display effect can be achieved.

FIG. 2 schematically shows a debugging procedure of the overdrive table of a TGB-FSC liquid crystal display device according to the embodiment of the present disclosure. As shown in FIG. 2, the two upper figures represent the partitions of the liquid crystal display device and the backlight. When the overdrive table of red color is debugged, in a first color field as shown by a first combination of liquid crystal display device and backlight in a left one of the two upper figures of FIG. 2, a first partition is activated by red backlight, and the first color field is scanned with a pre-determined overdrive gray-scale value. Specifically, when a gray-scale value of a target state of liquid crystal molecules is higher than a present gray-scale value of the liquid crystal molecules, a gray-scale value which is higher than the gray-scale value of the target state of the liquid crystal molecules is applied to the liquid crystal molecules; and when the gray-scale value of the target state of the liquid crystal molecules is lower than the present gray-scale value of the liquid crystal molecules, a gray-scale value which is lower than the gray-scale value of the target state of the liquid crystal molecules is applied to the liquid crystal molecules. Actually, a driving voltage corresponding to the above gray-scale value is applied to the liquid crystal molecules in practices. A scanning of a second color field is performed when the scanning of the first color field is completed. In the second color field as shown by a second combination of liquid crystal display device and backlight in a right one of the two upper figures of FIG. 2, a first partition is also activated by red backlight, and the second color field is scanned with a pre-determined overdrive gray-scale value. During follow-up procedures, the above steps are repeated when each value of the overdrive table is debugged.

The scanning procedure is sampled by a photoelectric sensor, and RGB brightness-time response curves are recorded by an oscilloscope or a personal computer with a memory. Gray-scale response times (including rising time and declining time) from a gray-scale value of an original frame to a gray-scale value of a target frame and overdrive voltages meeting a requirement thereof (which are converted into the corresponding overdrive gray-scale values) are recorded in the overdrive table, so that a lower table shown in FIG. 2 can be obtained. As shown in the overdrive table, the horizontal axis indicates gray-scale values of the present frame image, i.e., the gray-scale values of the present states of the liquid crystal molecules, and the vertical axis indicates gray-scale values of the target frame image, i.e., the gray-scale values of the target states of the liquid crystal molecules.

In the liquid crystal display device which is driven based on the partitions of the backlight, the partitions of the backlight being activated in an alternating manner would result in a flicker of the image, and thus the RGB brightness-time response curves recorded therein would distort. The influence of the flicker of the image should be taken into consideration when the overdrive table is debugged. Under such circumstances, on the one hand, a photoelectric sensor with a sensitive transient response, a desirable linearity range, and a good dynamic performance should be used; and on the other hand, the RGB brightness-time response curves recorded therein should be filtered to reduce the influence of noises. For example, the response curves can be handled by a median filtering algorithm.

A center of a partition is generally selected as a test point during debugging. When only one group of overdrive tables need to be debugged, it is not necessary to select the first partition upon which the debugging is performed. Instead, the overdrive table can be debugged based on any partition, such as a second partition, a third partition, or a fourth partition. According to the embodiment of the present disclosure, when the overdrive table is debugged, the brightness of the backlight used therein is set. Compared with the overdrive table which is debugged based on a single brightness of the backlight in the prior art, the overdrive table according to the present disclosure is more adaptive to the liquid crystal display device which is driven based on the partitions of the backlight. Therefore, the display effect thereof can be improved. Moreover, according to the present embodiment, the debugging is only performed on one partition, and thus the power consumption and the debugging time thereof can both be reduced.

When the debugging result of one partition is applied to another partition, for example, when the debugging result of the first partition is applied to the second partition of the liquid crystal display device, an error would occur, which is caused by interference among the partitions. As a result, the brightness of the backlight of the second partition, which is arranged between the first partition and the third partition, is slightly higher than that of the first partition or the third partition. Therefore, according to another embodiment of the present disclosure, a group of overdrive tables are debugged based on each of the partitions. In this case, during practical use, when the liquid crystal display device is driven based on different partitions, the corresponding overdrive tables are used. When the overdrive tables are debugged, the interference among the partitions of the backlight, such as diffusion of the backlight among the partitions, is taken into consideration, so that a better display effect can be obtained.

Figure 3:
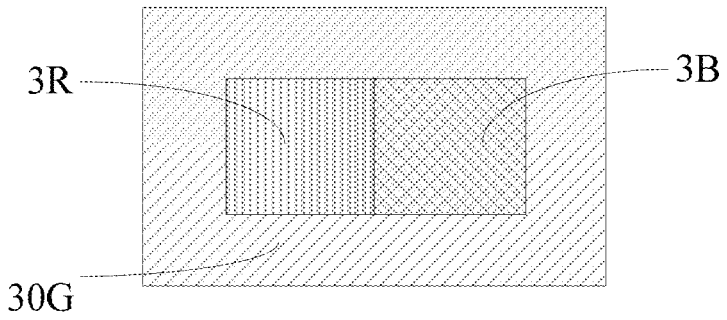
FIG. 3 schematically shows a structure of a LED backlight according to the embodiment of the present disclosure.

FIG. 3 schematically shows a structure of a Light Emitting Diode (LED) backlight according to the embodiment of the present disclosure. As shown in FIG. 3, the LED light source comprises three parts, i.e., a red light source 3R, a blue light source 3B, and green phosphor 30G that is arranged at a region surrounding the red light source and the blue light source.

During practices, the TGB-FSC liquid crystal display device with a backlight in a form of "Blue/Red chip plus Green phosphor" can be operated as follows. When one frame image is displayed, the red backlight is activated in the first color field, i.e., the red light source 3R of the Blue/Red chip plus Green phosphor LED is activated, while the blue light source 3B thereof is deactivated; and the white backlight is activated in the second color field, i.e., the red light source 3R and the blue light source 3B of the Blue/Red chip plus Green phosphor LED are both activated. Since the surrounding green phosphor 30G will be excited by the blue light source to emit light, the backlight presents a white color on the whole.

The overdrive table of the liquid crystal display device can be debugged under the following two debugging conditions.

A first debugging condition is that, in the TGB-FSC liquid crystal display device with a backlight in a form of "Blue/Red chip plus Green phosphor" LED, when the overdrive table of red color is debugged, red light is selected to serve as the backlight during debugging, i.e., the red light source 3R of the Blue/Red chip plus Green phosphor LED is activated, while the blue light source 3B thereof is deactivated. When the overdrive table of green color is debugged, white light is selected to serve as the backlight during debugging, i.e., the red light source 3R and the blue light source 3B of the Blue/Red chip plus Green phosphor LED are both activated. And when the overdrive table of blue color is debugged, white light is selected to serve as the backlight during debugging, and the on/off state of the backlight is the same as that when the overdrive table of green color is debugged.

It can be seen based on further analyses on the practical usage of the TGB-FSC liquid crystal display device that, the red color which transmits through the first color field is mainly generated by the red light source of the "Blue/Red chip plus Green phosphor" LED, while the blue color and green color which transmit through the second color field are mainly generated by the blue light source and the green phosphor which is excited by the blue light source of the Blue/Red chip plus Green phosphor LED. Hence, a second debugging condition of the overdrive table of the liquid crystal display device can be established according to the principle on which the backlight is selected during the preceding debugging procedures.

The second debugging condition is that, in the TGB-FSC liquid crystal display device with a backlight in a form of "Blue/Red chip plus Green phosphor" LED, when the overdrive table of red color is debugged, red light is selected to serve as the backlight during debugging, i.e., the red light source 3R of the Blue/Red chip plus Green phosphor LED is activated, while the blue light source 3B thereof is deactivated. When the overdrive table of green color is debugged, cyan light is selected to serve as the backlight during debugging, i.e., the red light source 3R of the Blue/Red chip plus Green phosphor LED is deactivated, while the blue light source 3B thereof is activated. And when the overdrive table of blue color is debugged, cyan light is selected to serve as the backlight during debugging, and the on/off state of the backlight is the same as that when the overdrive table of green color is debugged.

It should be noted that, during practical use of the liquid crystal display device, the red light source is also activated in the second color field. However, since the red light source cannot excite the green phosphor to emit green light, the blue backlight can be used alone when the overdrive table is debugged. The degrees of brightness of the backlights are different from each other under the two debugging conditions, and thus the overdrive tables obtained therein are slightly different from each other.

In addition, no matter which one of the above two debugging conditions is applied, the aforesaid requirements for the refresh rate of the backlight and the duty ratio thereof shall be met.

According to the method for debugging the overdrive table of the present disclosure, the overdrive table obtained therein can conform to the practical usage of the liquid crystal display device more precisely, and thus a better display effect can be achieved.

In the prior art, when the overdrive table is debugged, the backlight would not be partitioned. In this case, with respect to the liquid crystal display device which is driven based on the partitions of the backlight during practical use, the overdrive table obtained through such debugging would have a relatively large error. Moreover, in the prior art, when the overdrive table is debugged, the influence brought about by the alternation of the backlight is not taken into consideration, and a single backlight, in general a white light is used. As to the liquid crystals, the transmissivity of the light of one color (wavelength) is different from that of the light of other colors (wavelengths). Therefore, when the gray-scale value which is debugged with white backlight is applied to the liquid crystal display device with colored backlight, a relatively large error would occur, and thus a high quality displayed effect cannot be obtained.

According to the embodiments of the present disclosure, when the overdrive table is debugged, the above adverse factors are all taken into consideration and reflected in the overdrive table. That is, the overdrive table obtained through the debugging method according to the present disclosure can conform to the practical use condition of the liquid crystal display device better, so that a high quality display effect can be achieved.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A method for debugging an overdrive table, comprising the following steps:

partitioning a backlight into spatial partitions according to a partition mode of a liquid crystal display device;

selecting a backlight which is used when overdrive tables of different primary colors are debugged according to backlights of two color fields of the liquid crystal display device; and activating the backlight according to a refresh rate of color fields of the liquid crystal display device, and debugging overdrive gray-scale values in overdrive tables of different primary colors.

2. The method according to claim 1, wherein when an overdrive table of a primary color is debugged, a backlight of the backlights of the two color fields of the liquid crystal display device which represents the primary color better serves as the backlight which is used during debugging.

3. The method according to claim 2, wherein when an overdrive table of red color is debugged, a red backlight is selected; and when overdrive tables of green color and blue color are debugged, a white backlight or a cyan backlight is selected.

4. The method according to claim 1, further comprising debugging the overdrive gray-scale values in the overdrive tables of different primary colors based on any one of the partitions.

5. The method according to claim 1, further comprising, with respect to each of the partitions, debugging the overdrive gray-scale values in the overdrive tables of different primary colors, thus obtaining the overdrive tables corresponding to each of the partitions respectively.

6. The method according to claim 1, wherein a refresh rate of the backlight which is used during debugging is 120 Hz.

7. The method according to claim 6, wherein a duty ratio of the refresh rate ranges from 10% to 40%.

* * * * *